US007726179B2

(12) United States Patent
Müller et al.

(10) Patent No.: US 7,726,179 B2
(45) Date of Patent: Jun. 1, 2010

(54) METHOD AND DEVICE FOR MONITORING A FLUID FLOW DELIVERED BY MEANS OF A PUMP

(75) Inventors: Klaus Müller, Karlsruhe (DE); Sergei Gerz, Rheinstetten (DE)

(73) Assignee: Alldos Eichler GmbH, Pfinztal (DE)

( * ) Notice: Subject to any disclaimer, the term of this patent is extended or adjusted under 35 U.S.C. 154(b) by 244 days.

(21) Appl. No.: 11/911,377

(22) PCT Filed: Apr. 11, 2006

(86) PCT No.: PCT/EP2006/003299

§ 371 (c)(1),
(2), (4) Date: Oct. 12, 2007

(87) PCT Pub. No.: WO2006/108606

PCT Pub. Date: Oct. 19, 2006

(65) Prior Publication Data

US 2008/0190176 A1 Aug. 14, 2008

(30) Foreign Application Priority Data

Apr. 14, 2005 (DE) ..... 10 2005 017 240

(51) Int. Cl.
*G01M 3/02* (2006.01)

(52) U.S. Cl. ..... 73/37

(58) Field of Classification Search ..... 73/37
See application file for complete search history.

(56) References Cited

U.S. PATENT DOCUMENTS 2,446,335 A * 8/1948 Lee ..... 123/445
2,446,469 A * 8/1948 Gilbert ..... 123/462
3,733,963 A * 5/1973 Kubilos ..... 91/3
3,985,019 A * 10/1976 Boehme et al. ..... 73/61.56
5,006,110 A * 4/1991 Garrison et al. ..... 604/65
5,074,756 A * 12/1991 Davis ..... 417/45
5,772,963 A * 6/1998 Cantatore et al. ..... 422/67
5,792,967 A * 8/1998 Steber et al. ..... 73/862.23
6,092,370 A 7/2000 Tremoulet, Jr. et al.
6,105,724 A * 8/2000 Stitz et al. ..... 184/7.4
6,374,193 B1 4/2002 Kutscher et al.
6,975,935 B2 12/2005 Kohler et al.
6,997,683 B2 * 2/2006 Allington et al. ..... 417/18
7,069,183 B2 6/2006 Schluecker et al.
2004/0136833 A1 * 7/2004 Allington et al. ..... 417/44.1

(Continued)

FOREIGN PATENT DOCUMENTS

DE 43 09 380 A1 9/1994

(Continued)

*Primary Examiner*—Hezron Williams
*Assistant Examiner*—Rodney T Frank
(74) *Attorney, Agent, or Firm*—McGlew and Tuttle, P.C.

(57) ABSTRACT

The invention relates to a method and a device for monitoring a fluid flow delivered by means of a pump. In the method the pressure distribution of the fluid is continuously or quasi-continuously measured as actual values in partial areas of the pump stroke and compared with desired values. In the device at least one pressure sensor is provided for the continuous or quasi-continuous measurement of the pressure of a fluid at least in partial areas of the pump stroke and a comparator is provided for comparing the measured actual values of the pressure with desired values.

24 Claims, 7 Drawing Sheets

U.S. PATENT DOCUMENTS

| | | | |
|---|---|---|---|
| 2004/0226346 | A1 | 11/2004 | Schluecker et al. |
| 2005/0240337 | A1 | 10/2005 | Kohler et al. |

FOREIGN PATENT DOCUMENTS

| | | | |
|---|---|---|---|
| DE | 197 38 844 | A1 | 4/1999 |
| DE | 198 01 665 | A1 | 7/1999 |
| DE | 101 08 006 | A1 | 8/2002 |
| DE | 102 47 316 | A1 | 4/2004 |
| DE | 698 17 377 | T2 | 6/2004 |
| DE | 103 22 220 | B3 | 10/2004 |
| WO | WO 90/07942 | | 7/1990 |

* cited by examiner

Pressure distribution in the dosing chamber over the stroke in the case of cavitation Pressure distribution in the dosing chamber over the stroke for large gas inclusions Pressure distribution in dosing chamber over the stroke in the case of leaks in the pressure valve Pressure distribution in the dosing chamber over the stroke with outflowing leak in the suction valve or at another point in the dosing chamber

METHOD AND DEVICE FOR MONITORING A FLUID FLOW DELIVERED BY MEANS OF A PUMP

CROSS REFERENCE TO RELATED APPLICATIONS

This application is a United States National Phase application of International Application PCT/EP2006/003299 and claims the benefit of priority under 35 U.S.C. §119 of German Application 10 2005 017 240.7 filed Apr. 14, 2005, the entire contents of which are incorporated herein by reference.

FIELD OF THE INVENTION

The invention relates to a method and to a device for monitoring a fluid flow delivered by means of a pump.

BACKGROUND OF THE INVENTION

When a fluid is delivered by a pump a number of problems can arise. Thus, at a constant speed of the motor driving the pump the volume flow can be undesirably modified by pressure fluctuations in the system, e.g. can fall when the plant pressure rises. In addition, a number of faults can arise, such as an inadmissibly high cavitation, a flat or shallow pressure rise at the start of the pressure stroke with a reduced discharge capacity due to air or gas inclusions, leaks to the outer chamber and relative to the inlet and outlet valve (suction/pressure valve). If such faults occur, they should either be eliminated or there should at least be a corresponding fault report.

For fault detection purposes a system is known, in which a pressure sensor is fitted to the hydraulic chamber of a pump and measures the pressure in the chamber. This pressure is not representative for the pressure in the dosing or metering chamber, particularly as a result of the inherent rigidity of the diaphragm, which applies to a greater extent with the double diaphragms used for leak detection and also due to a possibly inserted return spring, without which a reliable suction function is often no longer ensured. Criteria for the detection of fault functions should solely be the average suction and discharge pressure, as well as the pump efficiency, which can only describe a fault behavior in a very global manner.

It is also known to provide a pressure sensor on the pressure side and to generate fault signals if the system pressure drops below a lower preset value and exceeds an upper preset value. This neither permits a pump control, nor a precise fault detection and identification.

For the detection of imperfect operating conditions of a pump it is known to record in time-based manner the pressure distribution over the piston stroke, in that during the piston travel pressure values are continuously recorded at constant time intervals and the pressure change is investigated over time. It is disadvantageous that this presupposes a known, fixed piston or motor movement with a constant angular velocity.

Therefore the problem of the invention is to provide a method and a device of the aforementioned type, by means of which a reliable, precise fault detection and identification is possible.

SUMMARY OF THE INVENTION

According to the invention the set problem is solved with a method of the aforementioned type, wherein the pressure of the fluid, at least over partial areas of the pump stroke, is measured continuously or quasi-continuously as actual values and compared with desired values. For solving the set problem the invention also provides a device of the aforementioned type, which has at least one pressure sensor for the continuous or quasi-continuous measurement of the fluid pressure at least in partial areas of the pump stroke and a comparator for comparing the measured actual pressure values with desired values. The latter are predetermined in type-specific manner for the given pump as empirical values as a result of the knowledge of pump parameters and the use of the pump, but also by a reference measurement from a faultless system.

According to a preferred development the actual values of the pressure are associated with positions of the piston or the pump diaphragm and are compared with the desired values corresponding to the same positions. The desired pressure values are preferably associated in an indicator diagram with the piston position, this corresponding to a faultless operation. Considered in general terms an indicator diagram is also a pressure distribution diagram, but specifically gives the pressure distribution over the piston travel, i.e. for the pressure and suction stroke, in the form of a closed line in the manner of a cycle. It is consequently much more universal than a pressure-time diagram which, as opposed thereto, is time and speed-dependent. The indicator diagram can be predetermined in type-specific manner either prior to the installation of the pump with the remaining software and/or during operation can in each case be generated anew in accordance with the situation. What is important is that the pressure distribution is determined over the piston travel and does not involve time and that a comparison takes place with the ideal desired values for a troublefree system, but not with imperfect operating conditions.

According to a preferred development of the inventive method the desired pressure values are determined at each measured time point from the running diagram of a pump driving the motor. The motor running diagram is understood to mean the course of the revolution (steps/angles/reference points) thereof over time. In the case of a speed-controlled motor which is used in preferred manner, the running diagram is preset by the speed control. Thus, as a result of a rigid coupling or transmission of the rotary movement of the drive motor with the piston or diaphragm by means of a transmission gear, the position of these parts is always known and consequently also give the movement or speed pattern of the piston, it being possible for the speed to differ and change. Thus, e.g. the rotary speed during the pressure stroke can be slower than during the suction stroke. The association of time and position is carried out by the drive system having the motor and the control thereof.

The motor is a stepwise reversible motor, such as a stepping motor, electronic commutation motor (EC motor), etc. The motor movement takes place by the stepwise control of the motor, so that the motor control always "knows" what is the situation of the motor and therefore the piston. A sensor for the instantaneous determination of the piston position over its entire travel is unnecessary and is not provided. However, for motor control synchronization purposes only, the drive system can have a synchronizing sensor provided with a specific piston position.

Whilst an extremely preferred development provides for measurement of the pressure in a pump dosing chamber, it is also possible to measure the pressure in a feed line or in a discharge line to or from the pump dosing chamber. As a result certain characteristic values can be determined. In a preferred development measurements take place in the dosing chamber and in a feed and/or discharge line. Thus, numerous values can be established for the determination of the most varied faults, partly also in redundant manner.

In another preferred development of the inventive method, during a pressure change, particularly in the pressure stroke and/or in the pressure line, the pump driving speed is adapted. This permits a pump control with respect to a constant or desired delivery. According to a preferred development of the invention a fault report is given if the actual pressure value differs from the desired value.

According to a preferred development the pressure distribution at the end of the suction stroke and/or at the beginning of the pressure stroke is monitored and if the actual pressure value remains in the vacuum range in both cases cavitation is present and is optionally reported.

On monitoring the pressure distribution in the compression phase of the pressure stroke, it is also possible to give a report indicating air/gas in the dosing chamber in the case of an actual pressure gradient being lower than a desired pressure gradient.

In another preferred development of the invention the pressure distribution is monitored in the region of the dead points or centers of the pump and in particular with a faster pressure rise at the start of the pressure stroke and/or a slow pressure reduction at the start of the suction stroke a leak in a pressure valve positioned downstream of the dosing head is reported. Moreover in the case of a premature pressure reduction at the end of the pressure stroke and/or a flat or shallow pressure rise at the start of the pressure stroke a leak of a suction valve located in the dosing head inflow is reported.

If the pressure is monitored during the pressure stroke, in the case of actual values exceeding the desired pressure value in the monitoring pattern a fault report is given. A pressure behavior indicating an unallowably high system pressure can e.g. occur if a pressure-side slide valve is closed in unauthorized manner.

In a further development with actual values dropping below the desired pressure value, a leak report indicating a leak in the pressure line can be given.

According to a further development of the device according to the invention, a speed-regulated motor is provided for driving the pump and its angular position can once again be used for determining the desired pressure values.

The comparator is in particular constructed in a computer, such as a PC, microcontroller, etc., and can in particular control a motor control for a pump motor. According to a further development of the inventive device input units can be provided for inputting input data, volume flow settings, evaluation strategies, maximum permitted pressure, etc., as well as output units for outputting output data, such as fault reports, pressure values, indicator diagrams or the like. Whereas in an extremely preferred development the pressure sensor is located in the dosing chamber further constructions can exist where a pressure sensor is positioned in a feed line to the dosing chamber and/or in a discharge line from the dosing chamber.

Within the scope of the invention the comparator continuously compares in critical phases of the pressure and suction stroke the instantaneous pressure distribution (actual value) with that of a faultless pressure distribution (desired value) and thus recognizes as a function of the magnitude of the variation whether the resulting dosing fault can be accepted or not and optionally emits a corresponding signal for the desired consequences. In this way the numerous fault causes existing in practice can be recognized and detected, such as cavitation, air bubbles, leaks and problems on the pressure and suction side. Moreover dosing errors as a result of pressure fluctuations on the pressure side can easily be compensated by speed adaptation.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
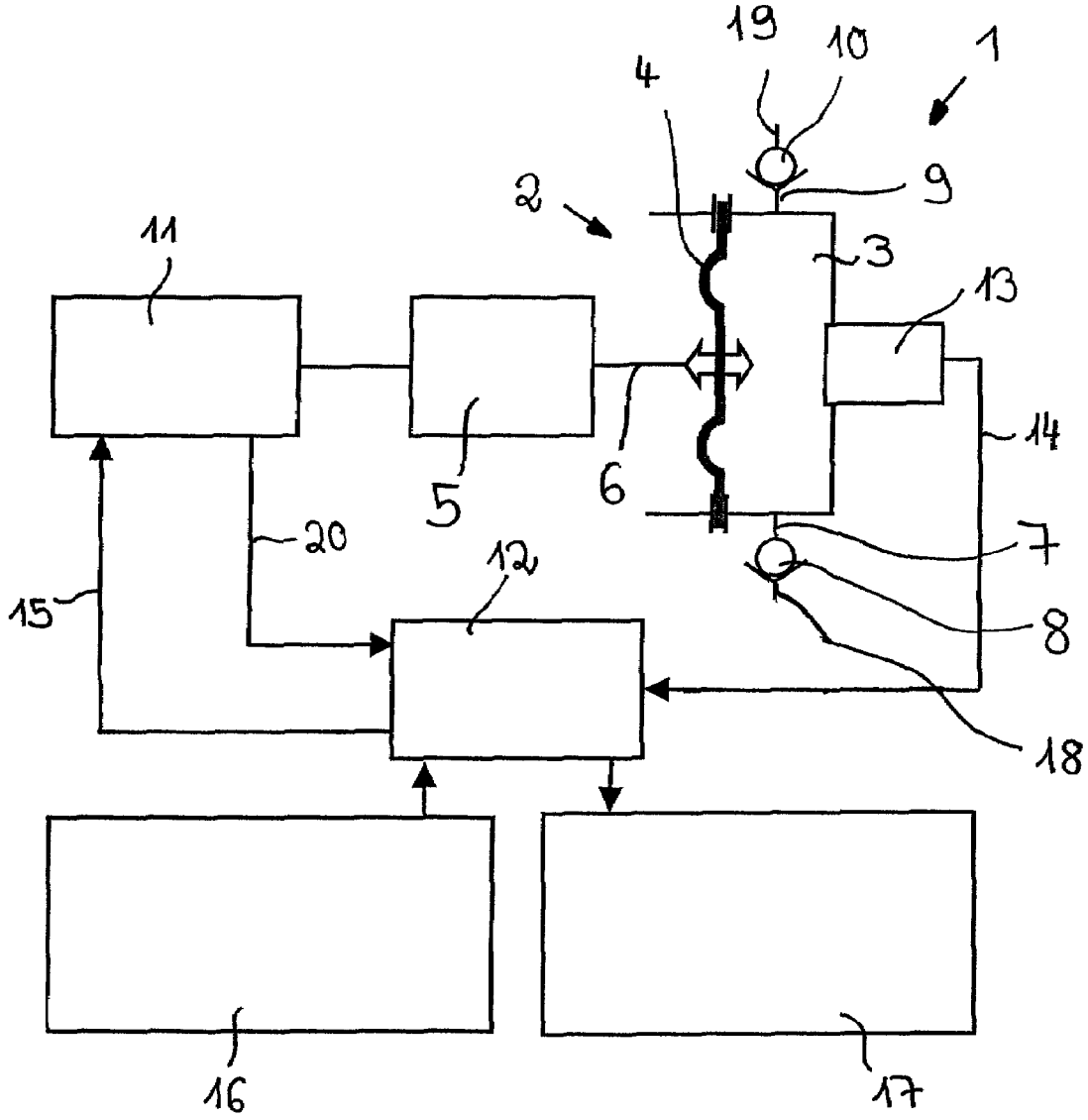
FIG. 1 is a schematic block diagram of an inventive device for monitoring a fluid delivered by a pump with a pressure sensor positioned in the dosing chamber.
Figure 2A:
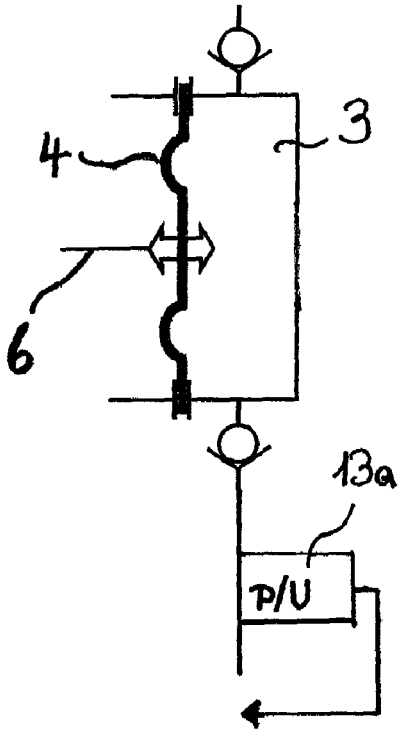
FIG. 2*a* is a schematic block diagram showing a further arrangement of individual or combined pressure sensors.
Figure 2B:
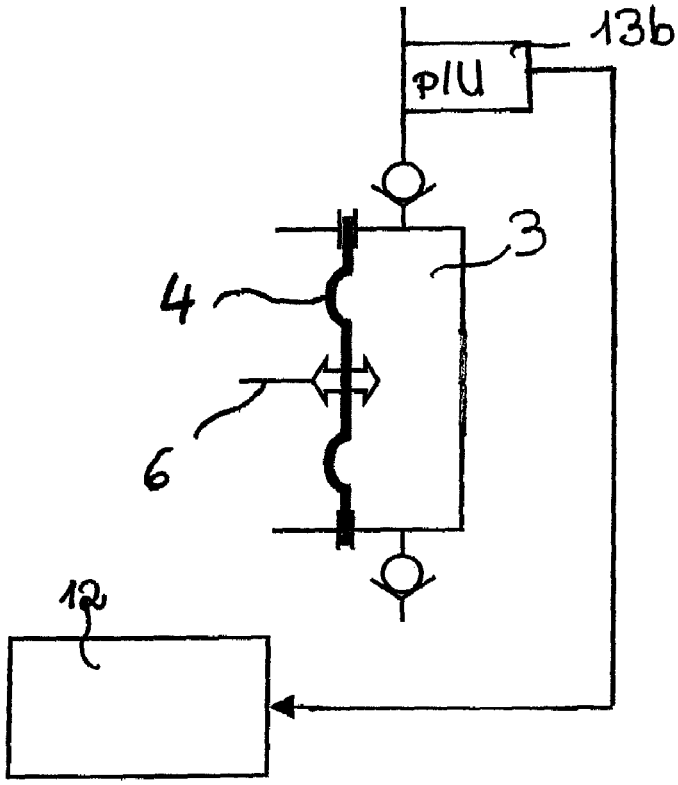
FIG. 2*b* is a schematic block diagram showing a further arrangement of individual or combined pressure sensors.
Figure 2C:
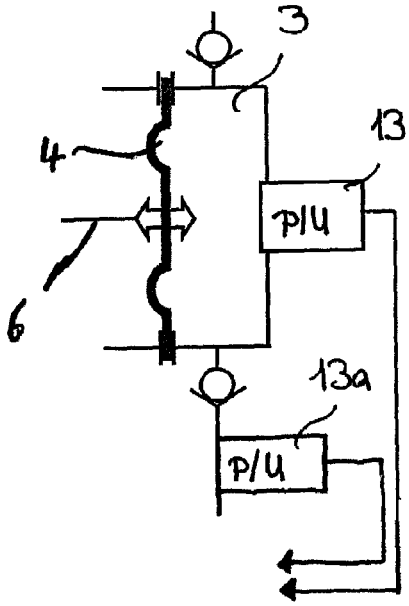
FIG. 2*c* is a schematic block diagram showing a further arrangement of individual or combined pressure sensors.
Figure 2D:
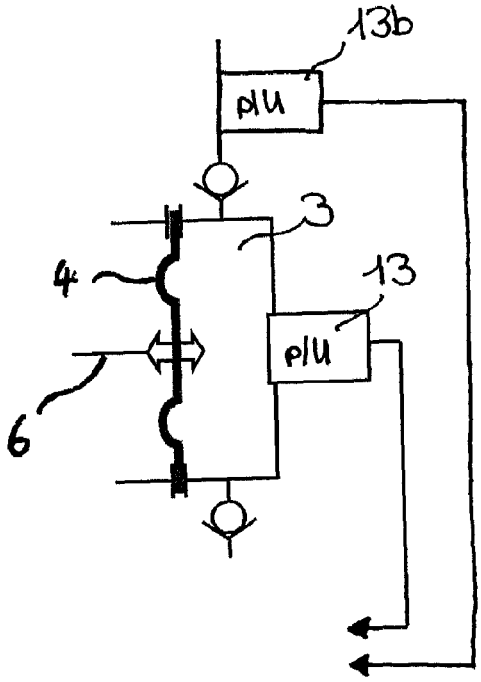
FIG. 2*d* is a schematic block diagram showing a further arrangement of individual or combined pressure sensors.
Figure 2E:
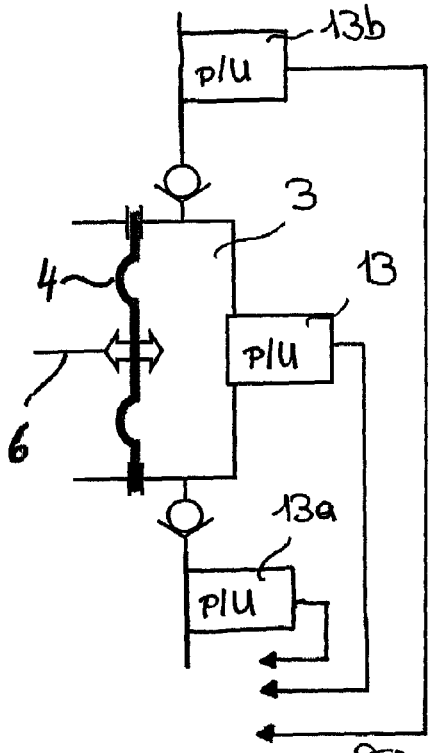
FIG. 2*e* is a schematic block diagram showing a further arrangement of individual or combined pressure sensors.
Figure 2F:
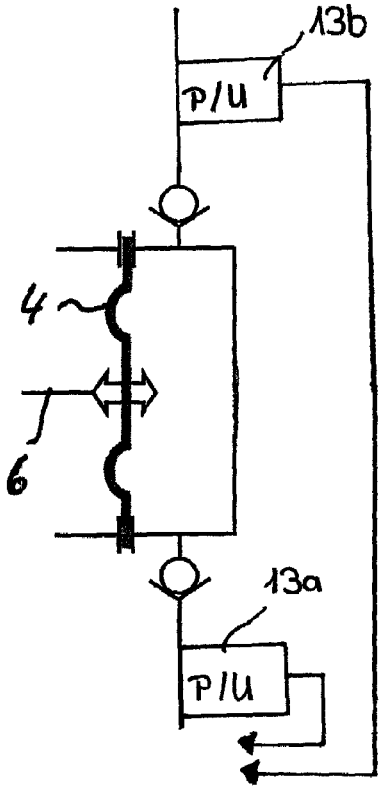
FIG. 2*f* is a schematic block diagram showing a further arrangement of individual or combined pressure sensors.

The preferred development of an inventive device 1 for monitoring a fluid delivered by a pump shown in FIG. 1 has a pump 2 with a dosing or metering chamber 3. In the embodiment shown the pump is in the form of a diaphragm pump and consequently has a diaphragm 4. The diaphragm 4 is driven and moved by the driven shaft of a motor 5. A suction valve 8 is located in an inlet 7 to dosing chamber 3 and a pressure valve in outlet 9 from dosing chamber 3.

With the motor 5 is associated a motor control 11 which on the one hand controls the motor operation and which on the other in the case of a speed-regulated motor, such as a stepping motor, reports a motor position to a computer 12 (PC, microcontroller), so that a running diagram of the piston with known piston position or speed always exists, so that at all times the control "knows" where the piston is. The dosing chamber contains a pressure sensor 13, which is in particular constructed as a pressure-stress transducer, and whose output signal is also supplied via a line 14 to computer 12. The computer 12 is constructed as a comparator for comparing the actual pressure values measured by pressure sensor 13 with desired pressure values determined from the motor position of motor control 11 within the framework of a desired pressure of a pump piston position with respect to indicator diagram of FIGS. 4 to 7 and for bringing about an action in the case where they do not coincide. This action can e.g. be a speed adaptation via control line 15 to motor control 11 so as in this way to adapt the motor speed. Input unit 16 and output unit 17 are also associated with computer 12. By means of the input units, such as a keyboard, bolt memory, etc. input data, such as a volume setting, evaluation strategies, maximum permitted pressure, etc. can be supplied to the computer 12. By means of the output units, such as screens, printers, loudspeakers, sirens, optical path indications, output data, such as fault reports, pressure values, indicator diagrams, etc. can be outputted.

FIGS. 2*a* to 2*f* show further developments of the arrangement of pressure sensors for pressure determination purposes. Thus, in the development of FIG. 2*a* a pressure sensor 13*a* is provided in suction line 18 and in the development of 2*b* a pressure sensor 13*b* is provided in pressure line 19 and in the developments of FIGS. 2*c* to 2*f* combinations of the pressure sensors 13, 13*a*, 13*b* are provided.

Thus, by means of a pressure sensor 13*a*, on the suction side the late start of a suction phase can be easily and precisely detected, whilst by means of a pressure sensor 13*b* on the pressure side a premature pressure reduction at the end of a pressure stroke and also a non-reaching of the output-side system pressure can be easily and precisely detected and in particular in combination with a pressure sensor 13 in the dosing chamber fault detection can be improved.

Figure 3:
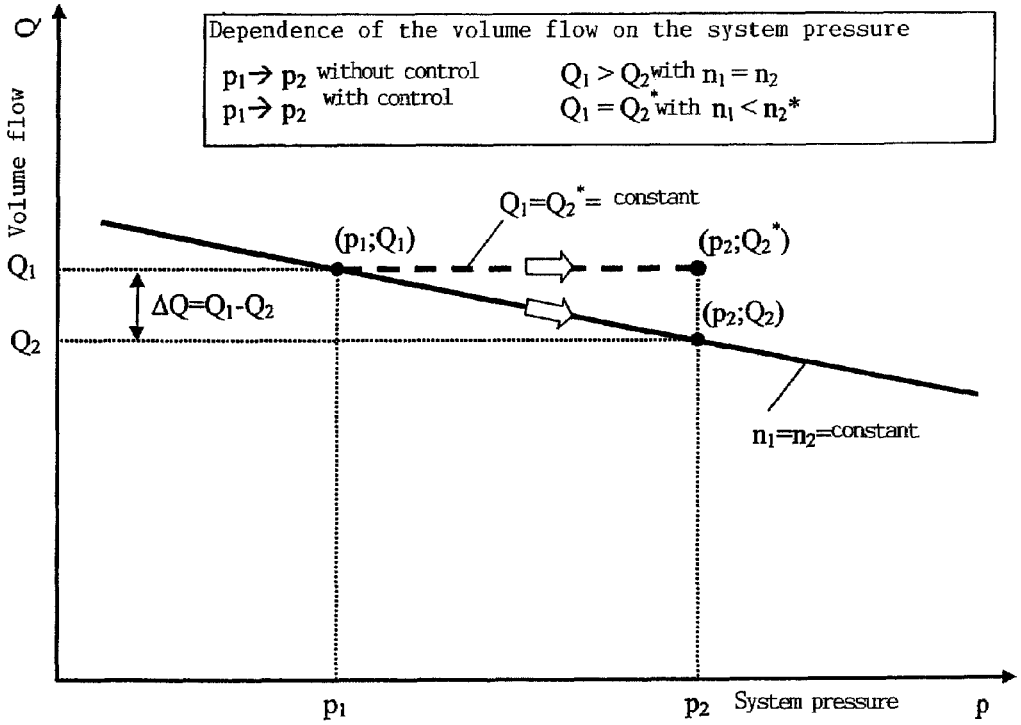
FIG. 3 is a diagram illustrating volume flow correction.

FIG. 3 shows the drop of the volume flow from $Q_1$ to $Q_2$ in the case of a constant speed $n_1=n_2$ and the system pressure rise from $p_1$ to $p_2$. This volume flow drop is compensated by computer 12 via motor control 11 by an increase on speed $n_2^*>n_1$ in such a way that the volume flow $Q_2^*=Q_1$ is kept the same.

FIGS. 4 to 7 show indicator diagrams (pressure distribution diagrams for the pressure over the stroke), the stroke position with pressure 0 being the maximum dosing chamber size position in which the diaphragm in FIG. 1 is drawn furthest to the left by the motor, whereas the stroke value 100% is the furthest right position of the diagram and therefore the greatest reduction of the dosing chamber, where the suction stroke commences.

Figure 4:
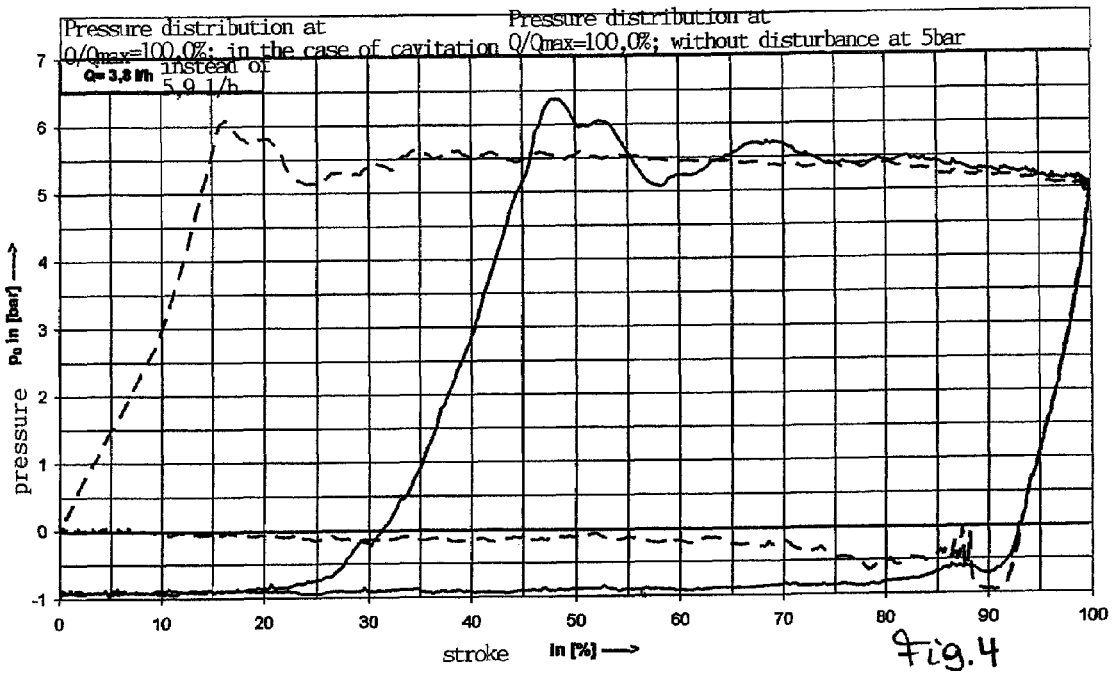
FIG. 4 is a diagram indicating cavitation in the dosing chamber (continuous line) compared with the normal pressure distribution (broken line)

FIGS. 4 to 7 show in broken line form the normal pressure distribution in the dosing chamber without any fault arising, i.e. a standard indictor diagram. A continuous line in FIG. 4 shows the pressure distribution when cavitation occurs, i.e. the formation of vapour bubbles at low pressure, during the suction stroke in the liquid delivery medium. The relative pressure during the suction stroke is negative and is below the pressure in the troublefree case. The pressure rise is also significantly delayed compared with the normal situation, i.e. in the initial pressure stroke phase is lower than the normal situation. At the beginning of the pressure stroke the actual pressure value remains in the vacuum range, so that in this way a dosing fault as a result of cavitation can be established.

Figure 5:
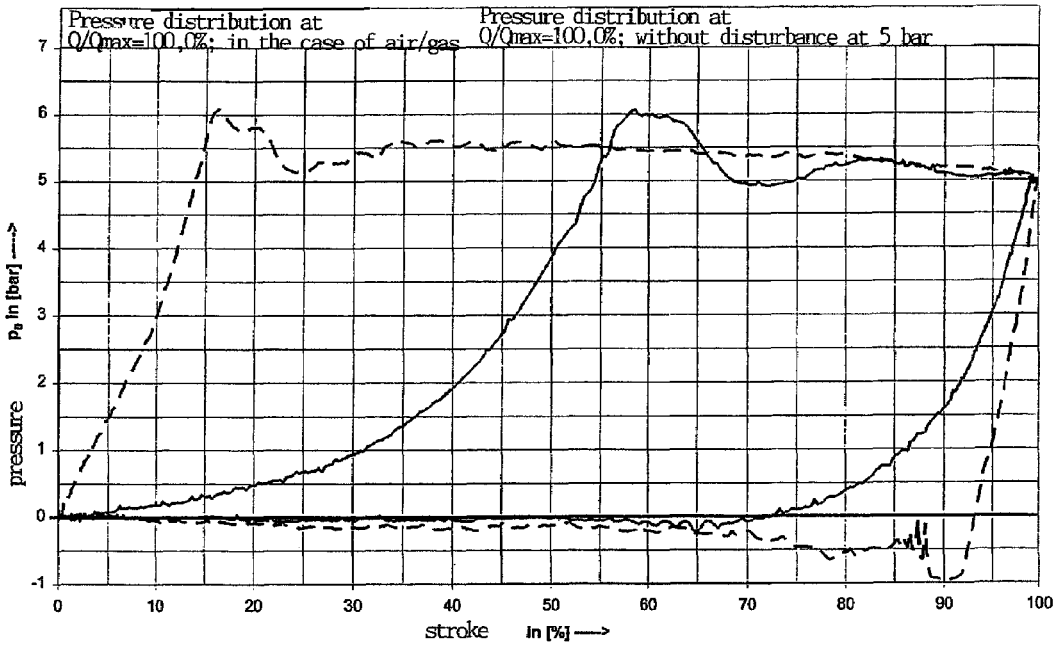
FIG. 5 is a diagram showing the pressure distribution over the stroke in the case of air or gas in the delivery chamber.

FIG. 5 shows by means of a continuous line the pressure distribution on the occurrence of air or gas (without cavitation). It can be seen that unlike n the case of cavitation the pressure rise starts at the beginning of the pressure stroke, but during the initial pressure stroke phase is much flatter than in the normal case. Thus, the occurrence of air or gas can in particular be established by the determination of the actual gradient of the pressure distribution compared with the desired gradient, so that a distinction can be made relative to cavitation, because in the case of the latter the gradient is much the same as during the normal pressure distribution.

Figure 6:
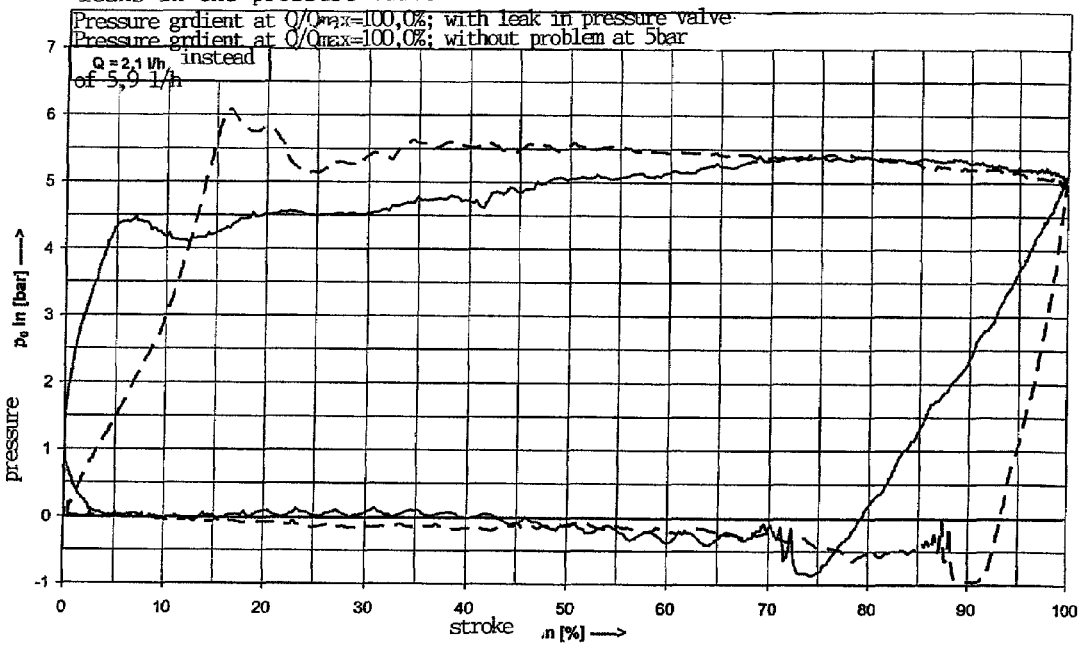
FIG. 6 is a diagram showing the pressure distribution in the case of a leak in the flow-remote pressure valve.

FIG. 6 also shows in continuous line form the pressure distribution when leaks occur in the pressure valve, i.e. the pressure valve does not completely close, so that at the start of the suction stroke the pressure drop is much slower than in the normal case, because liquid can flow back through the pressure valve. Moreover the pressure rise at the start of the pressure stroke is faster or earlier than is normally the case.

Figure 7:
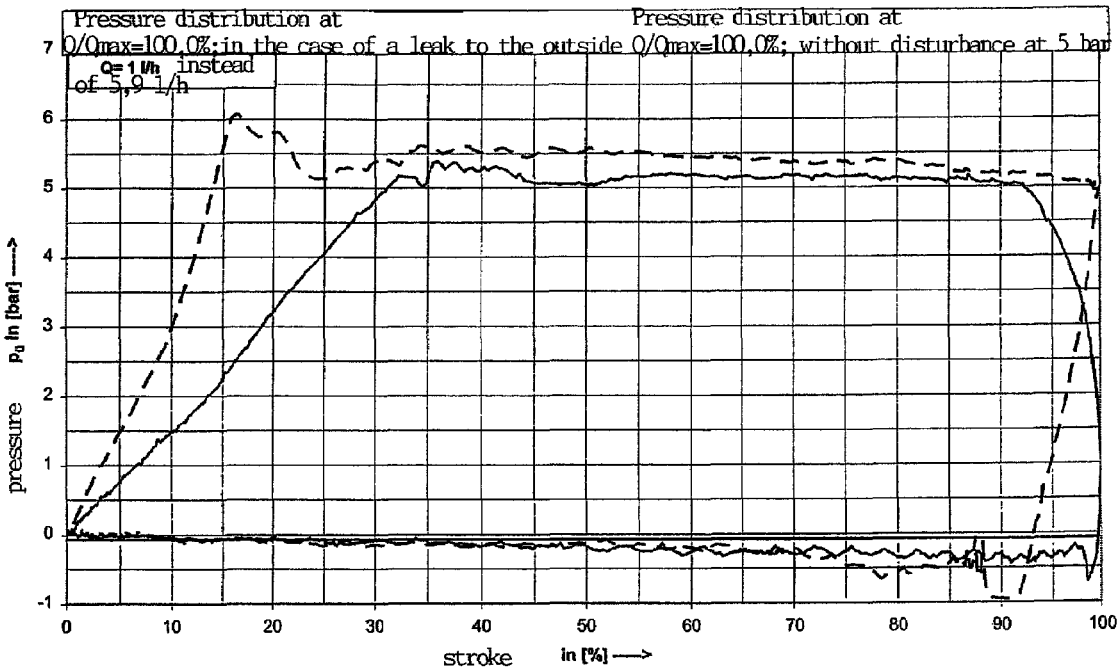
FIG. 7 is a diagram showing the pressure distribution in the case of an outflowing leak in the suction valve and/or to the exterior.

FIG. 7 shows in continuous line form the diagram for an outflowing leak in the suction valve and/or to the exterior. Here the leak not only causes a slow pressure rise, but the pressure can be lower than in the normal situation. There is also a premature pressure drop at the end of the pressure stroke.

Figure 8:
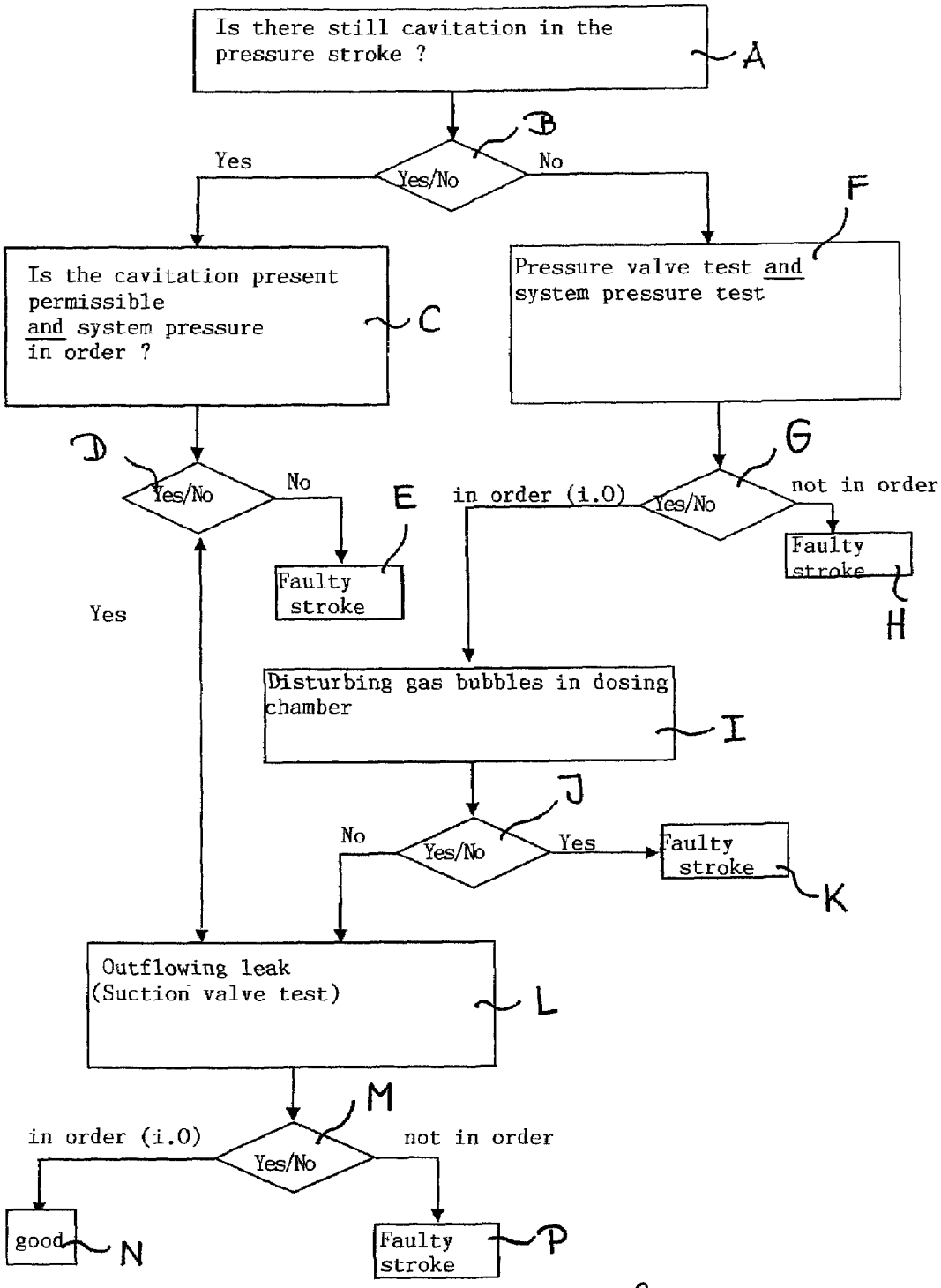
FIG. 8 is a flow chart concerning the sequence of the inventive method.

The sequence of a preferred development of the inventive method is represented in the diagram of FIG. 8. If at the end of the suction stroke and start of the pressure stroke the pressure remains in the vacuum range (steps A, B; FIG. 4), a check is made as to whether the cavitation present is still within a permitted range and/or the system pressure, in the further pressure stroke phase, corresponds to the predetermined pressure (steps C, D). If this is not the case, a fault signal is given relative to a faulty stroke indicating cavitation and/or a system pressure (step E).

If no cavitation is detected, a pressure valve test is performed, i.e. it is established whether the pressure drop at the beginning of the suction stroke is too slow and the pressure rise at the start of the pressure stroke is too fast. A system pressure test is also carried out for checking the pressures during the course of the pressure stroke and optionally suction stroke (step F; FIG. 6). If faults arise (step G), there is also a fault report concerning the faulty pressure valve (step H). If there are no faults, subsequently (step I) a check is made for disturbing gas bubbles in the dosing chamber according to FIG. 5, i.e. as to whether the gradient on pressure rise (and during pressure fall) is much flatter than during normal operation. If this is the case (inquiry J), a corresponding fault report (K) takes place.

If there is no inadmissible cavitation, or faulty pressure valve, or gas bubbles and correct system pressure, subsequently (step L) a test is made regarding the outflowing leak in the suction valve and/or to the exterior in accordance with FIG. 7, i.e. as to whether the pressure which has built up is too low, the pressure drop occurs at the end of the pressure phase and/or there is a lower pressure gradient in the compression phase.

If this is also in order (inquiry M), no further measures are needed (block N), otherwise a leak report (P) takes place.

While specific embodiments of the invention have been shown and described in detail to illustrate the application of the principles of the invention, it will be understood that the invention may be embodied otherwise without departing from such principles.

REFERENCE NUMERALS LIST

1 Device
2 Pump
3 Dosing chamber
4 Diaphragm
5 Motor
6 Driven shaft
7 Inlet
8 Suction valve
9 Outlet
10 Pressure valve
11 Motor control
12 Comparator

13, 13*a*, 13*b* Pressure sensor
14 Line
15 Control line
16 Input unit
17 Output unit
18 Suction line
19 Pressure line
20 Motor position report

The invention claimed is:

1. A method for monitoring a fluid flow delivered by a pump, the method comprising:

determining piston positions from the angular positions of a motor driving the piston, wherein the pressure of the fluid is measured at least in partial areas of the pump stroke in continuous or quasi-continuous manner as actual values relative to the determined piston position and said actual values are compared with desired values of the pressure over the piston position, wherein the pressure distribution at the end of the suction stroke is monitored and wherein cavitation is detected if the actual pressure value remains in the vacuum range.

2. A method according to claim 1, wherein the actual pressure values are associated with positions of the piston or pump diaphragm and compared with desired values corresponding to the same positions.

3. A method according to claim 1, wherein the desired pressure values are determined at each measured time point from the running diagram of a motor driving the pump.

4. A method according to claim 2, wherein the motor is speed-controlled.

5. A method according to claim 1, wherein the pressure is measured in a pump dosing chamber.

6. A method according to claim 1, wherein the pressure is measured in a pump suction line.

7. A method according to claim 1, wherein the pressure is measured in a pump pressure line.

8. A method according to claim 1, wherein the pump driving speed is adapted in the case of a change to the counter-pressure.

9. A method according to claim 1, wherein a fault report is given if the actual value differs from the desired value for the pressure.

10. A method according to claim 1, wherein the pressure distribution at the start of the pressure stroke is monitored.

11. A method according to claim 10, wherein a cavitation fault is indicated if the actual pressure value remains in the vacuum range.

12. A method according to claim 10, wherein a report indicating air/gas in the dosing chamber is given when the actual pressure gradient is lower than desired pressure gradients.

13. A method according to claim 1, wherein the pressure distribution in the vicinity of pump dead points is monitored.

14. A method according to claim 13, wherein in the case of a faster pressure rise at the start of the pressure stroke and/or a slow pressure drop at the start of the suction stroke a leak in a pressure valve positioned downstream of the dosing head is reported.

15. A method according to claim 13, wherein in the case of a premature pressure drop at the end of the pressure stroke and/or a flat compression line (pressure rise at the start of the pressure stroke) an outflowing leak of the suction valve located in the dosing head inflow and/or a leak to the exterior is reported.

16. A method according to claim 1, wherein the pressure during the pressure stroke is monitored.

17. A method according to claim 16, wherein a fault report is given if actual values exceed the desired pressure value.

18. A method according to claim 16, wherein in the case of actual values dropping below the desired pressure value, a leak report indicating a leak in the pressure line is given.

19. A method for monitoring a fluid flow delivered by a pump, the method comprising:

determining piston positions from the angular positions of a motor driving the piston, wherein the pressure of the fluid is measured at least in partial areas of the pump stroke in continuous or quasi-continuous manner as actual values relative to the determined piston position and said actual values are compared with desired values of the pressure over the piston position, wherein the pressure distribution at the start of the pressure stroke is monitored and a cavitation fault is indicated if the actual pressure value remains in the vacuum range.

20. A method for monitoring a fluid flow delivered by a pump, the method comprising:

determining piston positions from the angular positions of a motor driving the piston, wherein the pressure of the fluid is measured at least in partial areas of the pump stroke in continuous or quasi-continuous manner as actual values relative to the determined piston position and said actual values are compared with desired values of the pressure over the piston position, wherein the pressure distribution at the start of the pressure stroke is monitored and a report indicating air/gas in the dosing chamber is given when the actual pressure gradient is lower than desired pressure gradients.

21. A method for monitoring a fluid flow delivered by a pump, the method comprising:

determining piston positions from the angular positions of a motor driving the piston, wherein the pressure of the fluid is measured at least in partial areas of the pump stroke in continuous or quasi-continuous manner as actual values relative to the determined piston position and said actual values are compared with desired values of the pressure over the piston position, wherein the pressure distribution in the vicinity of pump dead points is monitored.

22. A method according to claim 21, wherein in the case of a faster pressure rise at the start of the pressure stroke and/or a slow pressure drop at the start of the suction stroke a leak in a pressure valve positioned downstream of the dosing head is reported.

23. A method according to claim 21, wherein in the case of a premature pressure drop at the end of the pressure stroke and/or a flat compression line (pressure rise at the start of the pressure stroke) an outflowing leak of the suction valve located in the dosing head inflow and/or a leak to the exterior is reported.

24. A method for monitoring a fluid flow delivered by a pump, the method comprising:

determining piston positions from the angular positions of a motor driving the piston, wherein the pressure of the fluid is measured at least in partial areas of the pump stroke in continuous or quasi-continuous manner as actual values relative to the determined piston position and said actual values are compared with desired values of the pressure over the piston position, wherein the pressure during the pressure stroke is monitored, wherein in the case of actual values dropping below the desired pressure value, a leak report indicating a leak in the pressure line is given.

* * * * *